US006382822B1

(12) United States Patent
Maekawa et al.

(10) Patent No.: US 6,382,822 B1
(45) Date of Patent: May 7, 2002

(54) VEHICULAR LAMP

(75) Inventors: Gen Maekawa; Nobutaka Tezuka, both of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/563,353

(22) Filed: May 3, 2000

(30) Foreign Application Priority Data

May 17, 1999 (JP) ..... 11-136293

(51) Int. Cl.[7] ..... F21V 5/04

(52) U.S. Cl. ..... 362/522; 362/521; 362/331; 362/332; 362/309

(58) Field of Search ..... 362/514, 518, 362/520, 521, 522, 297, 300, 309, 331, 332, 346, 547, 328

(56) References Cited

U.S. PATENT DOCUMENTS

| | | | | | |
|---|---|---|---|---|---|
| 4,588,619 | A | * | 5/1986 | Fiscus et al. | 362/522 |
| 4,644,455 | A | * | 2/1987 | Inglis et al. | 362/309 |
| 5,287,101 | A | * | 2/1994 | Serizawa et al. | 362/522 |
| 5,353,204 | A | * | 10/1994 | Kawamura | 362/522 |
| 5,580,165 | A | | 12/1996 | Natsume et al. | 362/331 |
| 5,658,072 | A | * | 8/1997 | Natsume et al. | 362/331 |
| 6,161,952 | A | * | 12/2000 | Schuster et al. | 362/522 |

FOREIGN PATENT DOCUMENTS

| | | | | |
|---|---|---|---|---|
| DE | 1186004 | * | 1/1965 | 362/331 |
| EP | 0 509 679 A2 | | 10/1992 | B60Q/1/26 |
| EP | 0 890 785 A2 | | 1/1999 | F21M/3/12 |
| FR | 2507741 | * | 12/1982 | 362/522 |

* cited by examiner

*Primary Examiner*—Sandra O'Shea
*Assistant Examiner*—Peggy A Neils
(74) *Attorney, Agent, or Firm*—Fish & Richardson P.C.

(57) ABSTRACT

A vehicular lamp having an inner lens is described. In an implementation, an annular wall 18A surrounding an optic axis Ax of a reflector 14 is formed on the inner lens 18 disposed between am outer lens 16 and a reflecting surface 14*a* of the reflector 14. The inner lens 18 is divided by the annular wall 18A into an internal zone 18B and an external zone 18C which may be different from each other in convex-concave lens shape. The internal zone 18B may be formed of a translucent lens, and a plurality of grid-type lens elements 18C*s* may be formed over the entire rear surface of the external zone 18C. Thus, an observer viewing the interior of a lighting chamber from a location in front of the lamp will see that the internal zone 18B and the external zone 18C, which are divided by the annular wall 18A, are significantly different. The configuration of elements provides a vehicular lamp that is visually attractive.

12 Claims, 3 Drawing Sheets

VEHICULAR LAMP

BACKGROUND OF THE INVENTION

The present invention relates to a vehicular lamp having an inner lens.

In general, as shown in FIG. 3, a vehicular lamp has a light source bulb 102, a reflector 104 having a reflecting surface 104*a* reflecting rays from the light source bulb 102 in a forward direction. An outer lens 106 is disposed forwardly of the reflector 104. FIG. 3 shows a conventional vehicular lamp in which an inner lens 18 is disposed between the outer lens 106 and the reflecting surface 104*a*. Use of the vehicular lamp having an inner lens 108 makes it possible to form diffusive lens elements 108*s* on the inner lens 108 and to use a translucent lens as the outer lens 106. Thus, it is possible to obtain a design which is different from that of a normal lighting fixture.

However, in such a conventional vehicular lamp, the inner lens 108 is simply formed of a flat surface or a single curved surface. Therefore, when the interior of the lighting chamber is observed from a location in front of the lighting fixture, the visual impression conveyed by the lighting fixture is unrelieved and monotonous. Thus, the lighting fixture is not visually attractive.

SUMMARY OF THE INVENTION

The present invention provides a vehicular lamp having an inner lens which enhances the visual attractiveness of the lighting fixture. A vehicular lamp according to the invention achieves an attractive appearance by using ingenuity in constructing the inner lens.

The vehicular lamp according to the invention comprises a light source bulb, a reflector having a reflecting surface that forwardly reflects rays from the light source bulb, an outer lens disposed forwardly of the reflector, and an inner lens located between the outer lens and the reflecting surface. The inner lens includes an annular wall that surrounds an optic axis of the reflector, and the inner lens is divided by the annular wall into an internal zone and an external zone which are different from each other in convex-concave lens shape.

The structure of the "reflecting surface" is not specifically limited. For example, the reflecting surface may have a smooth curved face or be formed of a plurality of reflector elements. Further, as long as the "annular wall" is formed to surround the optic axis of the reflector, the structure thereof is not specifically limited. Yet further, as long as the "internal zone" and the "external zone" are different from each other in convex-concave lens shape, the lens shapes of those zones are not specifically limited. For example, one of the zones may have lateral lens elements while the other may have vertical lens elements. Alternatively, one of the zones may have vertical or lateral lens elements while the other may have grid-type lens elements. Also, one of the zones may be formed as a translucent lens.

As is apparent from the construction of the vehicular lamp according to the present invention, the inner lens is located between the outer lens and the reflecting surface of the reflector, and is divided by the annular wall surrounding the optic axis of the reflector into internal and external zones which are different from each other in convex-concave lens shape. Therefore, the internal and external zones, which are divided by the annular wall, con be made significantly different in visibility. Thus, the present invention makes it possible to enhance the visual attractiveness of a lighting fixture in a vehicular lamp having an inner lens.

In the aforementioned construction, if the internal zone of the inner lens is composed of a substantially translucent lens, and a plurality of reflector elements are formed on the reflecting zone of the reflecting surface located rearwardly of the internal zone of the inner lens, the reflecting surface can be seen through the inner lens in the internal zone thereof. This configuration provides the lighting fixture with a sense of depth. Even when the lighting fixture is illuminated, the external zone of the inner lens and the reflecting surface located behind the internal zone are longitudinally offset from each other, which provides the lighting fixture with a sense of depth. In addition, if a plurality of reflector elements are formed on the reflecting surface located rearwardly of the internal zone of the inner lens, it is possible to assure the lighting fixture of required light distribution performance even though the internal zone is composed of a substantially translucent lens. The term "substantially translucent lens" includes a completely translucent lens and a translucent lens with a small number of lens elements.

A reflection processing may be performed for at least one of the outer and the inner peripheral surfaces of the annular wall, so that the light reflecting effect makes the presence of the annular wall 18A conspicuous. This makes it possible to enhance the dimensions of the lighting fixture. The term "reflection processing" is not specifically limited and may include, for example, spray painting and aluminum vaporization.

Furthermore, if the inner lens is composed of a colored lens (e.g. a red or amber lens) and the outer lens is composed of a clear lens (a colorless transparent lens) or a smoke lens (a slightly brownish transparent lens), the inner lens is easily visible through the outer lens, and the inner lens itself is also distinct. Accordingly, it is possible to emphasize the difference in visibility between the internal zone and the external zone of the inner lens to further enhance the visual attractiveness of the lighting fixture.

The internal and external zones of the "inner lens" may be coplanar with each other or longitudinally offset from each other. However, if the internal zone is forwardly offset from the external zone, then a more or less great distance may be set between the light source bulb and the inner lens. Thus, it is possible to emphasize the difference in visibility between the internal zone and the external zone of the inner lens while minimizing the possibility of the inner lens being deformed due to the heat generated by the light source bulb.

An embodiment of the present invention will be described hereinafter with reference to the drawings.

DETAILED DESCRIPTION

Figure 1:
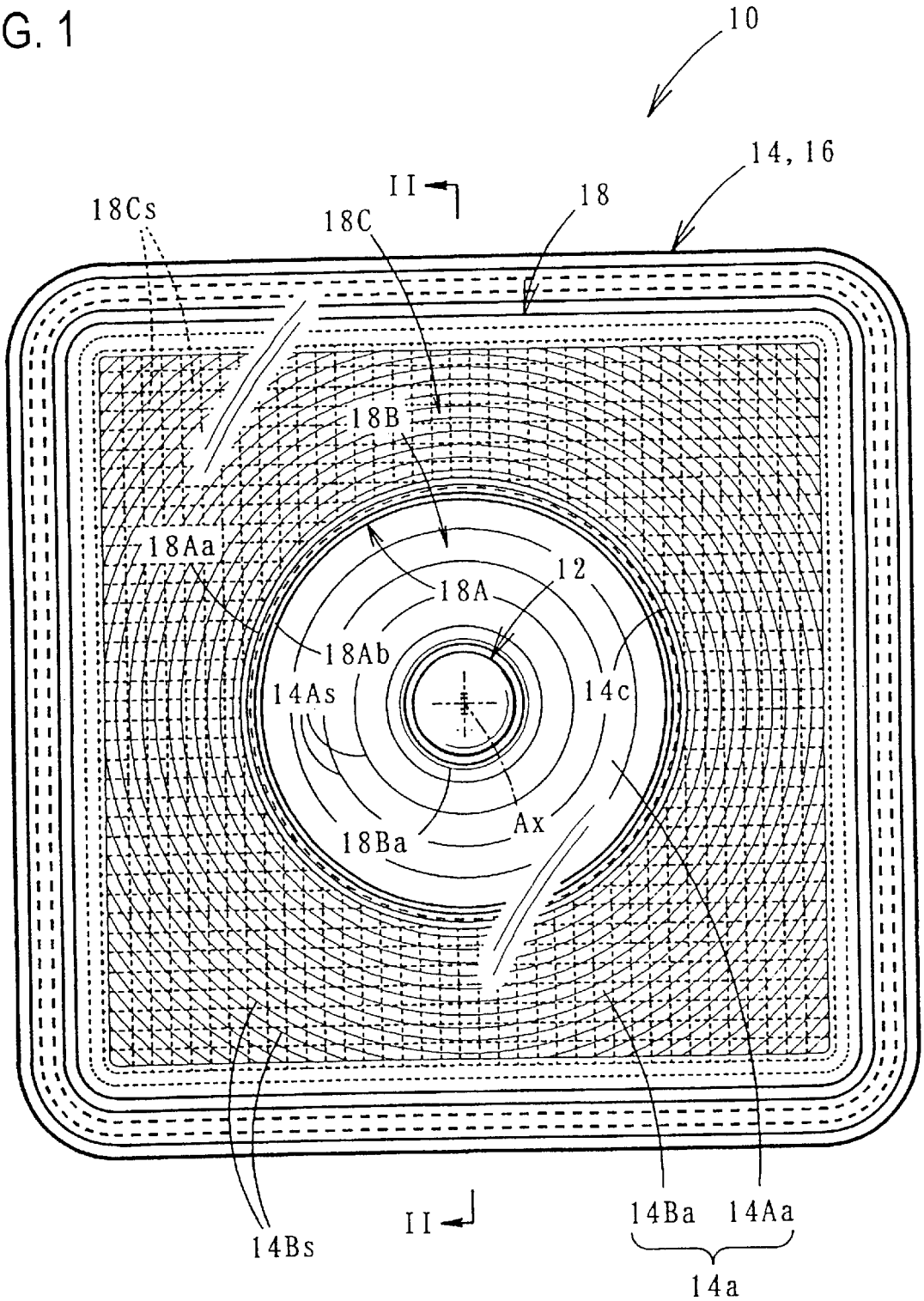
FIG. 1 is a front view of a vehicular lamp in accordance with an embodiment of the present invention.
Figure 2:
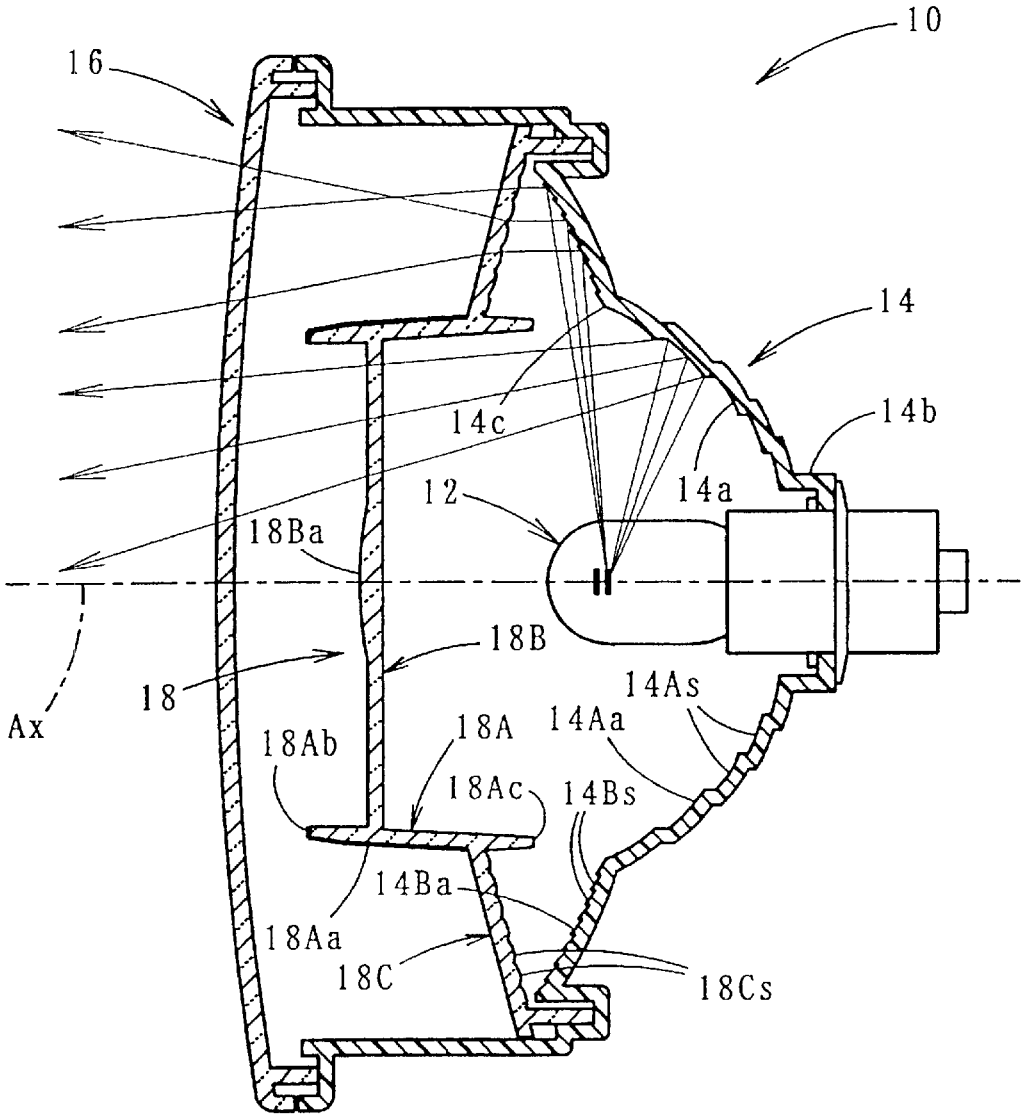
FIG. 2 is a cross-sectional view taken along a line II—II shown in FIG. 1.
Figure 3:
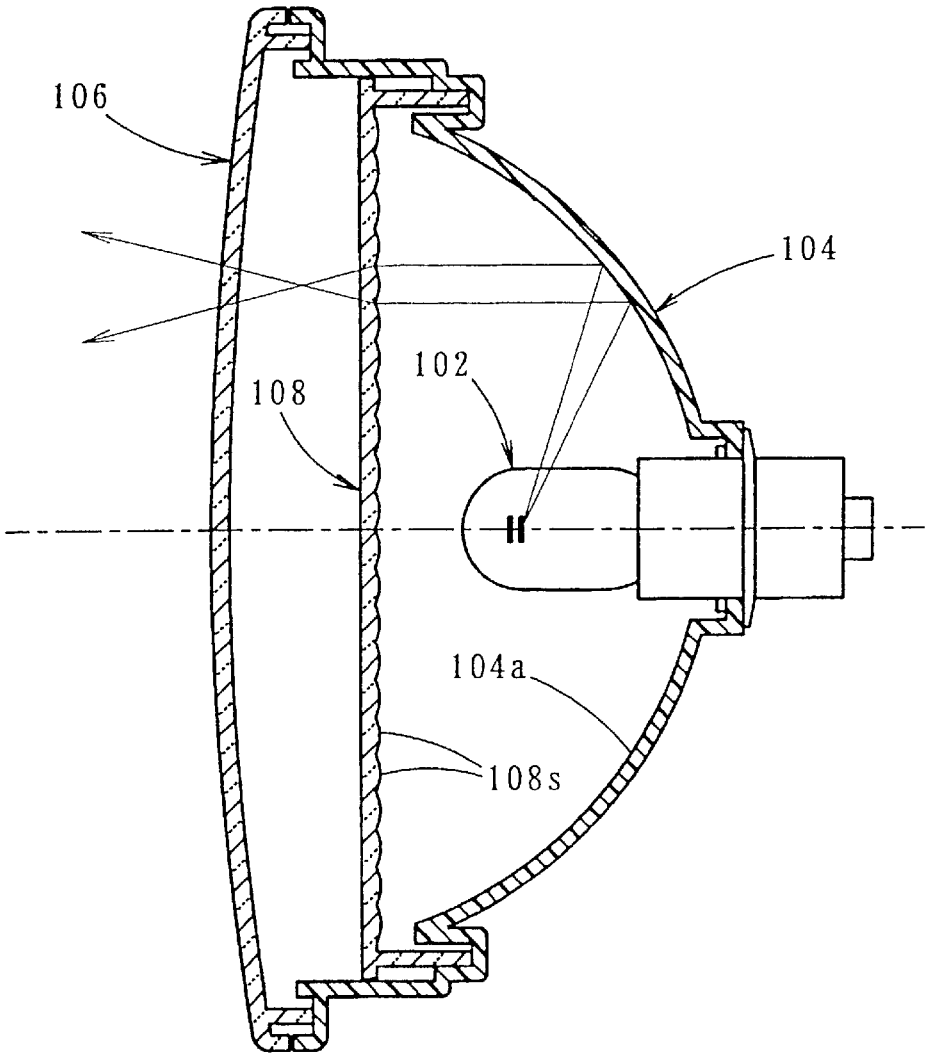
FIG. 3 PRIOR ART
FIG. 3 shows a conventional example of a vehicular lamp.

FIG. 1 is a front view of a vehicular lamp 10 in accordance with one embodiment of the present invention. FIG. 2 is a cross-sectional view taken along a line II—II shown in FIG. 1.

The example shown in these drawings of the vehicular lamp 10 is a tail lamp and a stop lamp. This lamp 10 has a light source bulb 12, a reflector 14 having a reflecting surface 14*a* for forwardly reflecting rays emitted from the light source bulb 12 (The rays are reflected forwardly with respect to the lighting fixture and rearwardly with respect to the vehicle. The same rays direction will hold true hereinafter). An outer lens 16 is disposed forwardly of the reflector 14, and an inner lens 18 is disposed between the outer lens 16 and the reflecting surface 14*a*.

The vehicular lamp 10 has a generally rectangular outer shape. The outer lens 16 may be welded to the reflector 14 at an outer peripheral edge of the vehicular lamp 10. The outer peripheral edge of the inner lens 18 may be welded to the reflector 14 on an inner periphery with respect to the portion where the outer lens 16 is welded to the reflector 14.

The light source bulb 12 is mounted to a bulb mounting portion 14*b* at the rear of the reflector 14 and is located on an optic axis Ax of the reflector 14. The reflecting surface 14*a* has a primary reflecting surface 14A*a* and a secondary reflecting surface 14B*a*. The primary reflecting surface 14A*a* is an annular zone having a predetermined diameter with its center located on the optic axis Ax. The secondary reflecting surface 14B*a* is located around the primary reflecting surface 14A*a* and has a different contour from that of the primary reflecting surface 14A*a*.

The primary reflecting surface 14A*a* may be composed of a plurality of separate reflector elements 14A*s* which are concentric with one another. The reflector elements 14A*s* may be formed in a stepped manner so that they are forwardly elevated as they are distanced from the optic axis Ax. Each of the reflector elements 14A*s* is designed to diffusively reflect rays emitted from the light source bulb 12 towards the optic axis Ax. The lighting fixture may be configured such that the primary reflecting surface 14A*a* performs all the functions of light distribution as it diffusively reflects the rays.

The secondary reflecting surface 14B*a* may also be composed of a plurality of separate reflector elements 14B*s* which are concentric with one another. However, the reflector elements 14B*s* may be arranged at a pitch much smaller than that of the reflector elements 14A*s* of the primary reflecting surface 14A*a*. These reflector elements 14B*s* may also be formed in a stepped manner so that they are rearwardly retracted as they are distanced from the optic axis Ax. Each of the reflector elements 14B*s* may be designed to reflect rays emitted from the light source bulb 12 generally parallel to the optic axis Ax. As a whole, the secondary reflecting surface 14B*a* has a surface contour which extends to bend with respect to the primary reflecting surface 14A*a* in a direction in which it is distanced from the optic axis Ax. Thus, the portion where the outer peripheral edge of the primary reflecting surface 14A*a* is connected to the inner peripheral edge of the secondary reflecting surface 14B*a* is formed as a circular edge 14*c*.

While the outer lens 16 may be composed of a translucent lens, the inner lens 18 may be composed of a red lens. The inner lens 18 has an annular wall 18A which extends substantially longitudinally to surround the optic axis Ax. The inner lens 18 is separated into an internal zone 18B and an external zone 18C by the annular wall 18A. The annular wall 18A may be generally cylindrically formed such that its diameter slightly decreases towards the front part thereof. The diameter of the rearmost end of the annular wall 18A may be somewhat smaller than the diameter of the circular edge 14*c*. The internal zone 18B is offset towards the front of the lamp with respect to the external zone 18C. The internal zone 18B is connected to the annular wall 18A at a location somewhat rearward of annular wall front end surface 18A*b*, whereas the external zone 18C is connected to the annular wall 18A at a location somewhat forward of an annular wall rear end surface 18A*c*.

The internal zone 18B is composed of a translucent lens that may be substantially flat and perpendicular to the optic axis Ax. However, a convex lens portion 18B*a* which is slightly larger in diameter than the light source bulb 12 may be formed on the front surface at the center of the, internal zone 18B. The external zone 18C may be in the shape of a conical surface so that its outer periphery side is set back with respect to a plane perpendicular to the optic, axis Ax. A plurality of lens elements 18C*s*, which may be divided like a grid, may be formed over the entire rear surface of the external zone 18C. Each of the lens elements 18C*s* may be formed as a fish-eye lens.

A reflection processing by means of aluminum vaporization may be performed for an outer peripheral surface 18A*a* and the front end surface 18A*b* of the annular wall 18A. This aluminum vaporization processing covers the area from the position where the annular wall 18A is connected to the external zone 18C to the inner peripheral edge of the front end surface 18A*b*.

Rays diffusively reflect from the primary reflecting surface 14A*a* of the reflector 14 of the lighting fixture central portion inward of the annular wall 18A, and are directly transmitted through the internal zone 18B of the translucent inner lens 18 and the outer lens 16, and are radiated forwardly of the lighting fixture. The lighting fixture thus obtains a required light distribution pattern. However, some of the rays diffusively reflected from the primary reflecting surface 14A impinge on a convex lens portion 18B*a* in the internal zone 18B of the inner lens 18, and those rays are further diffusively deflected by the convex lens portion 18B*a* towards the optic axis Ax. The parallel rays reflected from the secondary reflecting surface 14B*a* of the reflector 14 are transmitted through the external zone 18C of the inner lens 18 and are diffused vertically and laterally by a lens element 18C*s* of the eternal zone 18C. These diffused rays are directly transmitted through the outer lens 16 and radiated forwardly of the lighting fixture, and are much lower in luminosity than the rays radiated from the lighting fixture central portion.

The vehicular lamp 10 according to this embodiment has an inner lens 18 located between the outer lens 16 and the reflecting surface 14*a* of the reflector 14. The inner lens 18 has the annular wall 18A surrounding the optic axis Ax of the reflector 14, and the internal zone 18B and the external zone 18C are different from each other in convex-concave lens shape. Therefore, the interior of the lighting chamber as viewed from a location in front of the lighting fixture are visibly significantly different, wherein the internal zone 18B and the external zone 18C are divided by the annular wall 18A. This as configuration therefore provides an enhanced visual attractiveness of the lighting fixture in a vehicular lamp having an inner lens.

In this embodiment, the internal zone 18B of the inner lens 18 is composed of a translucent lens, and a plurality of reflector elements 14A*s* are formed on the primary reflecting surface 14A*a* of the reflector 14 (i.e. the reflecting zone of the reflecting surface 14*a* located rearwardly of the internal zone 18B of the inner lens 18). The primary reflecting surface 14A*a* can be seen through the inner lens 18. The lighting fixture thus provides a sense of depth. Even when the lighting fixture is illuminated, the external zone 18C of the inner lens 18 and the primary reflecting surface 14A*a* located behind the internal zone 18B are longitudinally offset from each other, which provides the lighting fixture with a sense of depth. In addition, since a plurality of reflector elements 14A*s* are formed on the primary reflecting surface 14A*a*, it is possible to assure that the distribution performance will be adequate even though the internal zone 18B of the inner lens 18 is composed of a translucent lens. In this implementation, the convex lens portion 18B*a* is slightly larger in diameter than the light source bulb 12 and is formed on the central front surface of the internal zone 18B of the inner lens 18. Thus, the light source bulb 12 does not shine directly into to the eyes of an observer when viewed from a location in front of the lighting fixture. This construction makes it possible to avoid marring the visual attractiveness of the lighting fixture that otherwise would occur if a translucent lens were used in the internal zone 18B of the inner lens 18.

In this embodiment, reflection processing by means of aluminum vaporization is performed for the outer peripheral surface 18A*a* and the front end surface 18A*b* of the annular wall 18A. Therefore, the light reflecting effect from these surfaces makes the presence of the annular wall 18A conspicuous, which makes it possible to enhance the dimensions of the lighting fixture.

Furthermore, according to this embodiment, the inner lens 18 and the outer lens 16 are composed of a red lens and a smoke lens respectively. Thus, the inner lens 18 is easily visible through the outer lens 16, and the inner lens 18 itself is distinct. Accordingly it is possible to emphasize the difference in visibility of the internal zone 18B and the external zone 18C of the inner lens 18 to thereby further enhance the visual attractiveness of the lighting fixture.

Since the internal zone 18B of the inner lens 18 is forwardly offset from the external zone 18C, it is possible to set a more or less great distance between the light source bulb 12 and the inner lens 18. Thus, it is possible to emphasize the difference in visibility between the internal zone 18B and the external zone 18C of the inner lens 18 while minimizing the possibility of the inner lens 18 being deformed due to the heat generated by the light source bulb 12.

The reflecting surface 14*a* of the reflector 14 is composed of the primary reflecting surface 14A*a*, located rearwardly of the internal zone 18B of the inner lens 18, and the secondary reflecting surface 14B*a*, located outwardly of the primary reflecting surface 14A*a*. The primary reflecting surface 14A*a* and the secondary reflecting surface 14B*a*, which are divided by the circular edge 14C, may have different surface contours. Further, the reflecting surface 14*a* in the lighting fixture central portion differs significantly in luminosity from the reflecting surface 14*a* in the lighting fixture peripheral portion. Accordingly it is possible to highlight the dimensions of the lighting fixture by emphasizing the contrast of luminosity between the lighting fixture central portion and the lighting fixture peripheral portion.

The light distribution functions of this implementation of a lighting fixture are allotted to the primary reflecting surface 14A*a*. Therefore, the secondary reflecting surface of the lighting fixture may be designed to irradiate diffused rays merely for the sake of decoration. This configuration therefore makes it possible to further enhance the visual attractiveness of the lighting fixture.

Although an embodiment has been described having an annular wall 18A that is generally cylindrical and formed in the central portion of the inner lens 18 around the optic axis Ax, it should be understood that the annular wall 18A may be shaped differently. Further, although the described embodiment shows an outer lens 16 that is composed of a smoke lens, the outer lens 16 may be clear so that the inner lens 18 would be even more visible. Yet further, although the description of this embodiment includes a unitary outer lens 16, the outer lens 16 may be formed of a plurality of lens elements.

A reflector 14 which also serves as the lamp body has been described, but the lighting fixture may also be designed to have a separate lamp body that accommodates a reflector 14. Furthermore, although the described embodiment is a vehicular tail lamp and a stop lamp, operation and effects similar to those described can also be achieved for other types of vehicular lamps of other types employ a similar construction.

What is claimed is:

1. A vehicular lamp comprising:

a light source bulb, a reflector having a reflecting surface that reflects rays from the light source bulb to the front of the lamp, an outer lens disposed forwardly of the reflector, and an inner lens located between the outer lens and the reflecting surface, wherein the inner lens includes an annular well surrounding an optic axis of the reflector and wherein the inner lens is divided by the annular wall into a substantially convex internal zone and a substantially concave external zone.

2. The vehicular lamp according to claim 1, wherein the reflecting surface includes a plurality of reflector elements located rearwardly of the internal zone.

3. The vehicular lamp according to claim 1, wherein a reflective surface is formed on at least one of an inner and an outer peripheral surface of the annular wall.

4. The vehicular lamp according to claim 1, wherein the inner lens is composed of a colored lens; and the outer lens is composed of at least one of a clear lens and a smoke lens.

5. The vehicular lamp according to claim 1 wherein the internal zone is forwardly offset from the external zone.

6. The vehicular lamp according to claim 2, wherein a reflective surface is formed on at least one of an inner and an outer peripheral surface of the annular wall.

7. The vehicular lamp according to claim 2, wherein the inner lens is composed of a colored lens; and the outer lens is composed of at least one of a clear lens and a smoke lens.

8. A method for fabricating a vehicular lamp comprising:

fabricating a reflector having a reflecting surface to reflect light from a light source bulb;

fabricating an inner lens that includes an annular wall that divides the lens into a substantially convex internal zone and a substantially concave external zone;

connecting the inner lens to an inner periphery of the reflecting surface such that the annular wall surrounds an optic axis of the reflector to enhance the appearance of the vehicular lamp; and connecting an outer lens to an outer periphery of the vehicular lamp.

9. The method of claim 8, wherein a plurality of reflector elements are fabricated on the reflecting surface rearward of an internal zone.

10. The method of claim 8, further comprising coating at least one of an inner and an outer peripheral surface of the annular wall with reflective material.

11. The method of claim 8, further comprising fabricating the internal zone of the annular lens to be forwardly offset from the external zone.

12. A vehicular lamp comprising:

a light source bulb;

a reflector having a reflecting surface;

an outer lens disposed forwardly of the reflector; and an inner lens located between the outer lens and the reflecting surface, wherein the inner lens includes an annular wall surrounding an optic axis of the reflector and wherein the inner lens is divided by the annular wall into a substantially convex internal zone that is substantially translucent and a substantially concave external zone, and wherein a portion of the reflecting surface located behind the internal zone includes a plurality of reflector elements.

* * * * *